US007775034B2

(12) United States Patent
Suzuki et al.

(10) Patent No.: US 7,775,034 B2
(45) Date of Patent: Aug. 17, 2010

(54) CONTROL DEVICE AND CONTROL METHOD TO EXHAUST PURIFICATION DEVICE

(75) Inventors: Hisanobu Suzuki, Toyota (JP); Tadachika Namiki, Kariya (JP); Kenji Kawai, Kariya (JP)

(73) Assignees: Toyota Jidosha Kabushiki Kaisha, Toyota-shi (JP); Kabushiki Kaisha Toyota Jidoshokki, Kariya-shi (JP)

( * ) Notice: Subject to any disclaimer, the term of this patent is extended or adjusted under 35 U.S.C. 154(b) by 332 days.

(21) Appl. No.: 11/488,055

(22) Filed: Jul. 18, 2006

(65) Prior Publication Data

US 2007/0017216 A1 Jan. 25, 2007

(30) Foreign Application Priority Data

Jul. 19, 2005 (JP) ..... 2005-209127

(51) Int. Cl.
*F01N 3/00* (2006.01)

(52) U.S. Cl. ..... 60/286; 60/274; 60/295; 60/301

(58) Field of Classification Search ..... 60/286, 60/295, 285, 274, 301
See application file for complete search history.

(56) References Cited

U.S. PATENT DOCUMENTS 5,406,790 A * 4/1995 Hirota et al. ..... 60/276
5,974,791 A * 11/1999 Hirota et al. ..... 60/276
6,314,935 B2 * 11/2001 Tanaka et al. ..... 123/298
6,516,612 B1 * 2/2003 Yokoi et al. ..... 60/301
6,814,303 B2 * 11/2004 Edgar et al. ..... 239/128
6,834,496 B2 * 12/2004 Nakatani et al. ..... 60/274
6,877,312 B2 * 4/2005 Nakatani et al. ..... 60/288
6,951,098 B2 * 10/2005 Xu et al. ..... 60/286
2003/0089334 A1 * 5/2003 Yomogida ..... 123/300
2004/0187483 A1 * 9/2004 Dalla Betta et al. ..... 60/286
2005/0091967 A1 * 5/2005 Sisken ..... 60/285
2005/0137779 A1 * 6/2005 Gioannini et al. ..... 701/103

FOREIGN PATENT DOCUMENTS

| | | |
|---|---|---|
| EP | 1 211 396 A2 | 6/2002 |
| EP | 1 298 291 A2 | 4/2003 |
| EP | 1 498 594 A1 | 1/2005 |
| JP | 6-50134 | 2/1994 |
| JP | 2004-308464 | 11/2004 |
| WO | WO 2004/061278 A1 | 7/2004 |

* cited by examiner

*Primary Examiner*—Thomas E Denion
*Assistant Examiner*—Diem Tran
(74) *Attorney, Agent, or Firm*—Oblon, Spivak, McClelland, Maier & Neustadt, L.L.P.

(57) ABSTRACT

A control device of an exhaust purification device is provided with a plurality of addition valves that supply an additive pressure-fed from a pump, to exhaust purification catalysts separately from each other. As for addition valves constituting the plurality of addition valves the addition period of at least one addition valve is set so as to be different from the addition period of another addition valve.

25 Claims, 10 Drawing Sheets

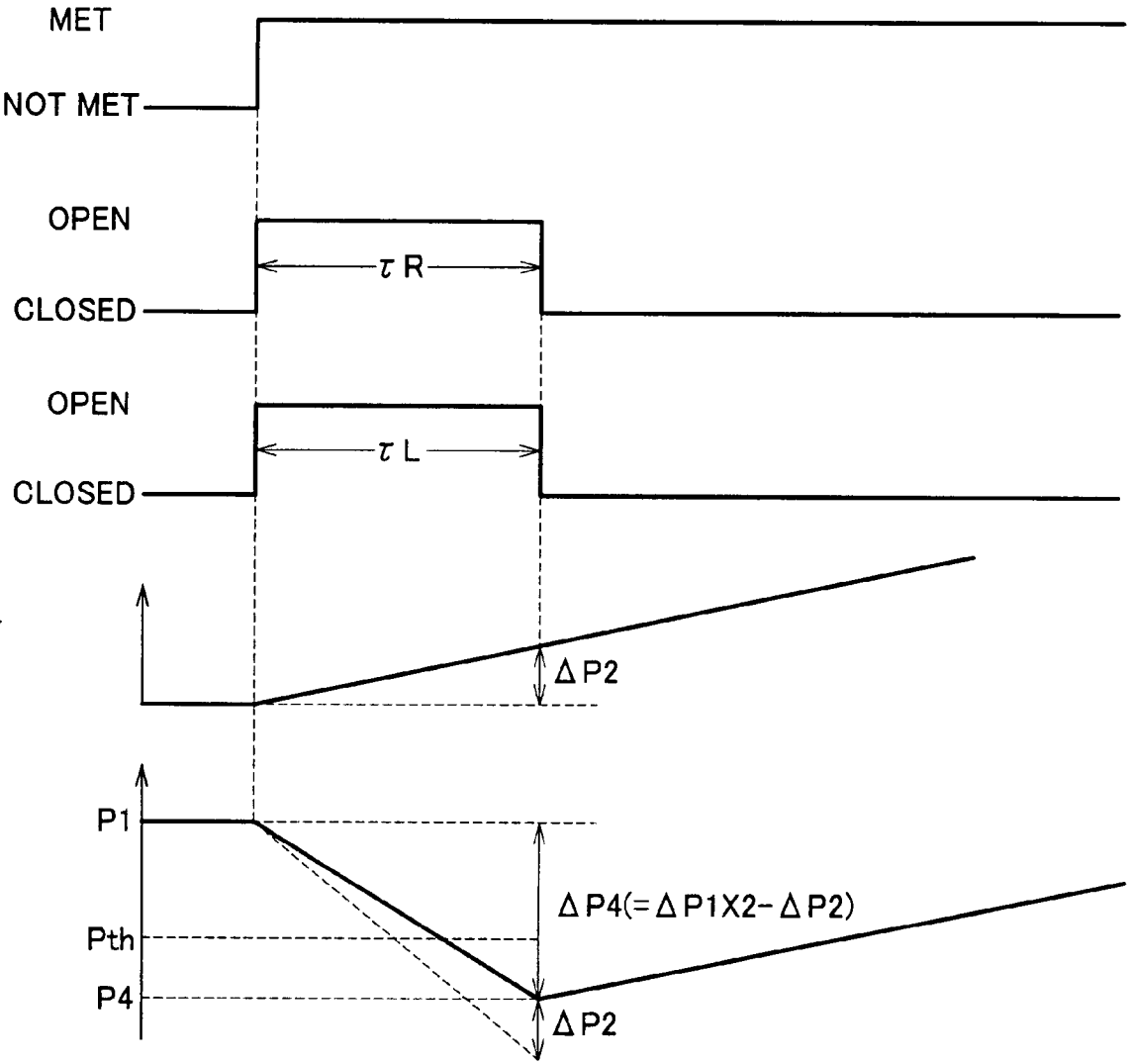
FIG. 4A CONDITION FOR FUEL ADDITION
FIG. 4B OPEN/CLOSED STATE OF RIGHT-SIDE ADDING VALVE 22R
FIG. 4C OPEN/CLOSED STATE OF LEFT-SIDE ADDING VALVE 22L
FIG. 4D CONTRIBUTION OF PRESSURE RECOVERY TO CHANGES IN FUEL PRESSURE IN COMMON PORTION 72
FIG. 4E FUEL PRESSURE P IN COMMON PORTION 72

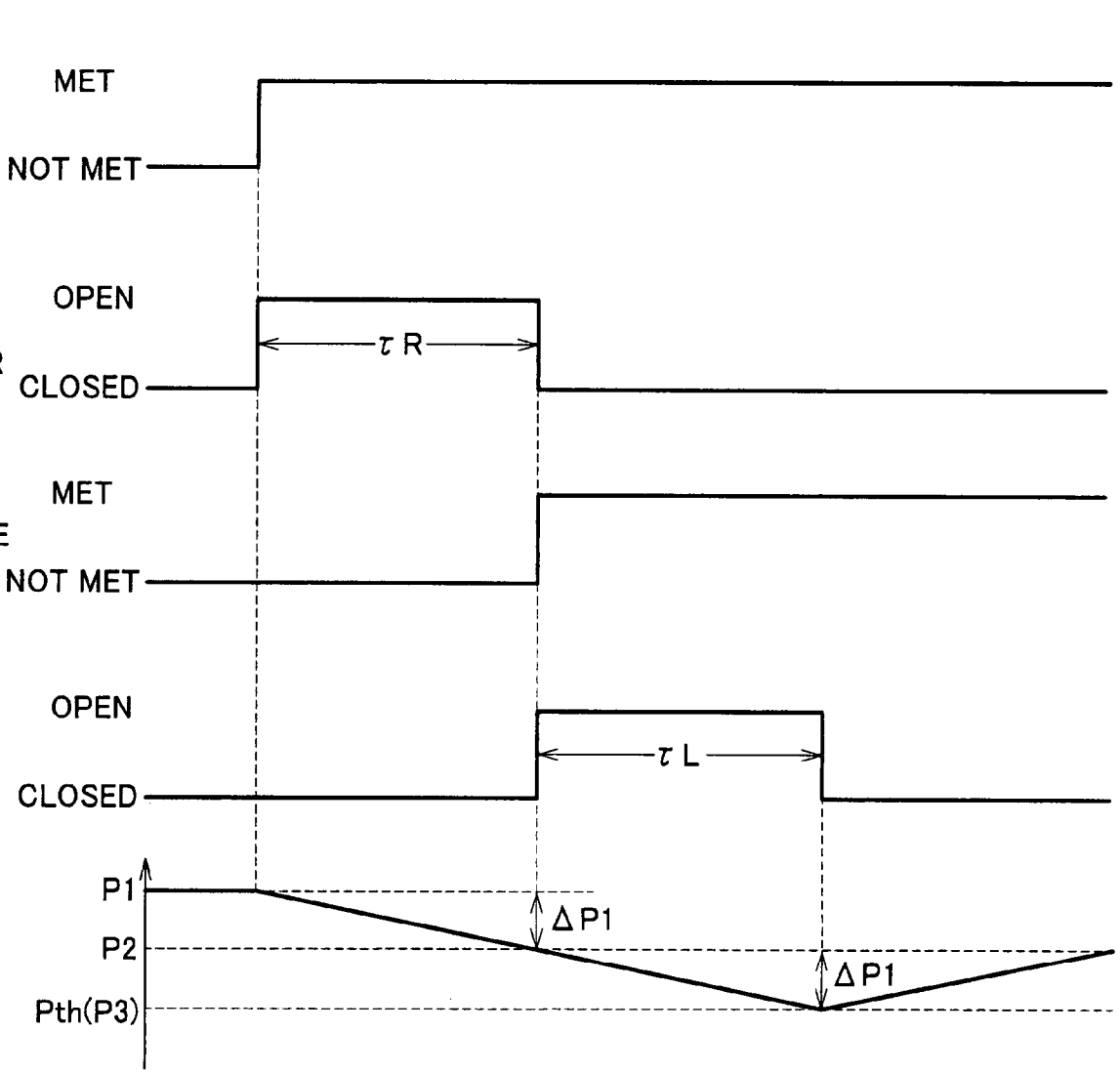
FIG. 5A CONDITION FOR FUEL ADDITION TO RIGHT-SIDE CATALYST PORTION 24R
FIG. 5B OPEN/CLOSED STATE OF RIGHT-SIDE CATALYST PORTION 22R
FIG. 5C CONDITION FOR FUEL ADDITION TO LEFT-SIDE ADDING VALVE 24L
FIG. 5D OPEN/CLOSED STATE OF LEFT-SIDE ADDING VALVE 22L
FIG. 5E FUEL PRESSURE P IN COMMON PORTION 72

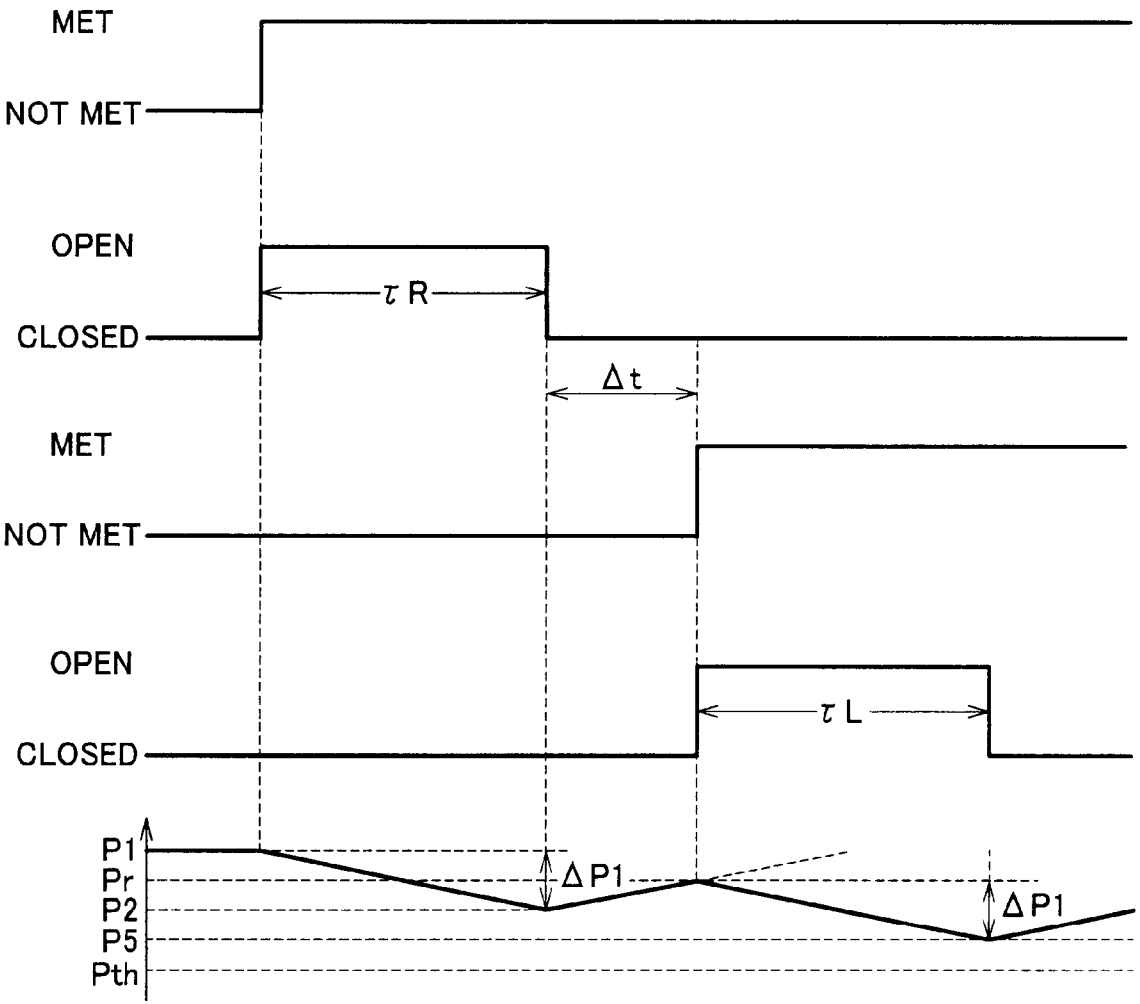
FIG. 7A CONDITION FOR FUEL ADDITION TO RIGHT-SIDE CATALYST PORTION 24R
FIG. 7B OPEN/CLOSED STATE OF RIGHT-SIDE ADDING VALVE 22R
FIG. 7C CONDITION FOR FUEL ADDITION TO LEFT-SIDE CATALYST PORTION 24L
FIG. 7D OPEN/CLOSED STATE OF LEFT-SIDE ADDING VALVE 22L
FIG. 7E FUEL PRESSURE P IN COMMON PORTION 72

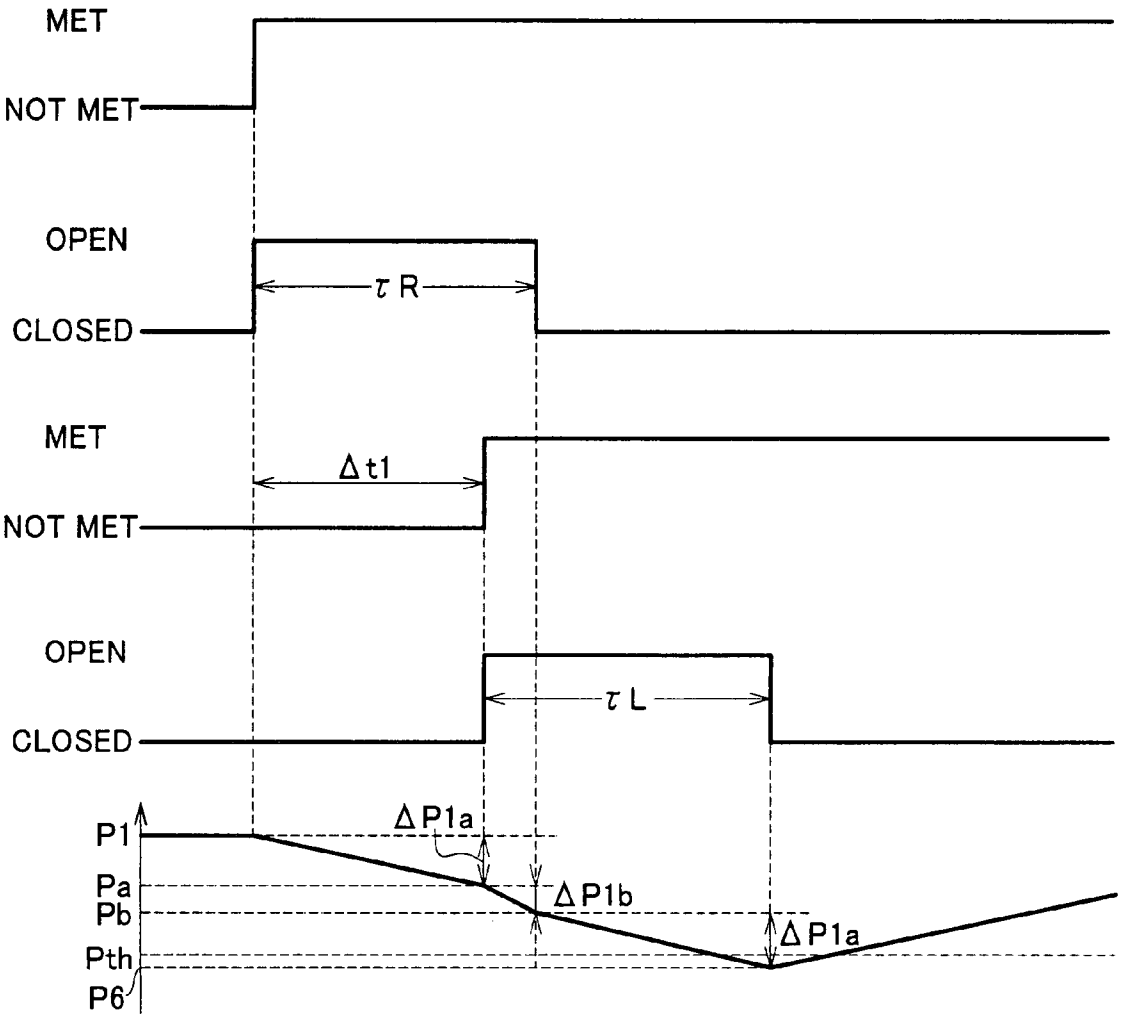
FIG. 8A CONDITION FOR FUEL ADDITION TO RIGHT-SIDE CATALYST PORTION 24R
FIG. 8B OPEN/CLOSED STATE OF RIGHT-SIDE ADDING VALVE 22R
FIG. 8C CONDITION FOR FUEL ADDITION TO LEFT-SIDE CATALYST PORTION 24L
FIG. 8D OPEN/CLOSED STATE OF LEFT-SIDE ADDING VALVE 22L
FIG. 8E FUEL PRESSURE P IN COMMON PORTION 72

CONTROL DEVICE AND CONTROL METHOD TO EXHAUST PURIFICATION DEVICE

INCORPORATION BY REFERENCE

The disclosure of Japanese Patent Application No. 2005-209127 filed on Jul. 19, 2005 including the specification, drawings and abstract is incorporated herein by reference in its entirety.

BACKGROUND OF THE INVENTION

1. Field of the Invention

The invention relates to a control device and a control method of an exhaust purification device.

2. Description of the Related Art

Some diesel engines and the like have, in their exhaust passageways, an exhaust purification device that includes a catalyst for purifying the exhaust gas. Examples of such catalysts include a NOx storage-reduction catalyst, which remove NOx (oxides of nitrogen) by the reduction thereof, and the like. The NOx storage-reduction catalyst stores NOx from the exhaust gas in an oxidizing atmosphere, and releases stored NOx and reduces it to nitrogen in a reducing atmosphere. Specifically, when a predetermined condition regarding the engine operation state or the like is met, fuel in the fuel tank is pressure-fed, by a supply pump, through a supply passageway to an addition valve that is provided upstream of the installed position of the catalyst, and the fuel is supplied from the addition valve into the exhaust passageway (Japanese Patent Application Publication No. JP-A-6-50134).

In engines having two systems of exhaust passageways, for example, a V-type engine, each exhaust system is provided with exhaust purification devices 20R, 20L as shown in FIG. 1. Therefore, it is necessary to dispose addition valves 22R, 22L for supplying fuel to the exhaust purification devices 20R, 20L, respectively. However, because two addition valves 22R, 22L are used, the amount of fuel supplied is greater than in the case where fuel is added using a single addition valve. This greatly reduces the fuel supplying pressure. As a result, the degree of atomization of fuel in exhaust passageways 2R, 2L may deteriorate, so that the fuel may not be sufficiently supplied to the surface of the catalyst, and therefore the exhaust purification rate may drop.

The foregoing problem is not limited to the exhaust pipes into which a reductant, such as fuel or the like, is supplied, but also is generally shared by exhaust pipes into which an additive other than fuel is supplied.

SUMMARY OF THE INVENTION

The invention provides a control device and a control method of an exhaust purification device that is capable of curbing the decline of the exhaust purification rate by curbing the deterioration of the degree of atomization of an additive.

A first aspect of the invention is a control device of an exhaust purification device that includes a plurality of addition valves for supplying an additive pressure-fed from a pump to a plurality of separate exhaust purification catalysts, wherein, as for addition valves constituting the plurality of addition valves, an addition period of at least one addition valve is set so as to be different from an addition period of another addition valve.

This will curb the drop of the supply pressure of the additive caused by simultaneous supply of the additive from the plurality of addition valves. As a result, the above-described construction, in comparison with a construction in which the additive is supplied simultaneously from all of addition valves, is able to maintain a higher supply pressure for the additive relatively, and hence is able to curb the deterioration of the degree of atomization of the additive and therefore curb the decline of the exhaust purification rate.

In a second aspect of the invention the plurality of addition valves are two addition valves that are provided separately in two systems of exhaust passageways, and in which, as for the two addition valves, the addition period of one addition valve is set so as not to overlap with the addition period of the other addition valve. Therefore, the addition periods of the two addition valves shift from each other. Hence, the above-described construction is able to curb the drop of the supply pressure of the additive which is caused when the additive is supplied via the addition valves.

A third aspect of the invention may be formed as follows. In a supply passageway that supplies the additive, provided between the pump and the plurality of addition valves, branch portions within the supply passageway are connected to the plurality of addition valves, and a common portion to which the branch portions are joined and which is connected to the pump. It is to be noted herein that if the additive is supplied simultaneously from the plurality of addition valves, the pressure of the additive in the common portion of the supply passageway greatly drops, and therefore the supply pressure of the additive drops.

Therefore, in the third aspect of the invention, the addition period of at least one addition valve is set so as to be different from the addition period of another addition valve. Hence, although the exhaust purification device has the above-described construction, the third aspect is able to curb the deterioration of the degree of atomization of the additive and therefore curb the decline of the exhaust purification rate.

A fourth aspect of the invention is similar to the third aspect, expect that the supply of the additive via the addition valves begins when the pressure of the additive in the common portion is greater than or equal to a predetermined magnitude.

According to this construction, when the supply of the additive via the addition valves begins, the pressure of the additive in the common portion of the supply passageway, which connects the pump and the addition valves, is greater than or equal to a predetermined magnitude. Therefore, the fourth aspect is able to curb the deterioration of the degree of atomization of the additive and therefore curb the decline of the exhaust purification rate.

The invention may be applied to a control device of an exhaust purification device that includes addition valves provided separately in the two systems of exhaust passages of a V-type engine.

A fifth aspect of the invention is a control method for an exhaust purification device that includes a plurality of addition valves for supplying an additive pressure-fed from a pump to a plurality of separate exhaust purification catalysts. As for addition valves constituting the plurality of addition valves, the method sets an addition period of at least one addition valve so as to be different from an addition period of another addition valve.

BRIEF DESCRIPTION OF THE DRAWINGS

The foregoing and further objects, features and advantages of the invention will become apparent from the following description of preferred embodiments with reference to the accompanying drawings, wherein like numerals are used to represent like elements and wherein:

FIGS. 4A to 4E are time charts showing a relationship between the open/closed states of addition valves and the fuel pressure in the common portion of the supply passageway;

FIGS. 5A to 5E are time charts showing a relationship between the open/closed states of addition valves and the fuel pressure in the common portion of the supply passageway;

FIGS. 7A to 7E are time charts showing a relationship between the open/closed states of addition valves and the fuel pressure in the common portion of the supply passageway;

FIGS. 8A to 8E are time charts showing a relationship between the open/closed states of addition valves and the fuel pressure in the common portion of the supply passageway;

DETAILED DESCRIPTION OF THE PREFERRED EMBODIMENTS

A first embodiment of the invention is shown as a control device of an exhaust purification device disposed on a V-type 6-cylinder diesel engine, as shown in detail with reference to FIGS. 1 to 5E.

Figure 1:
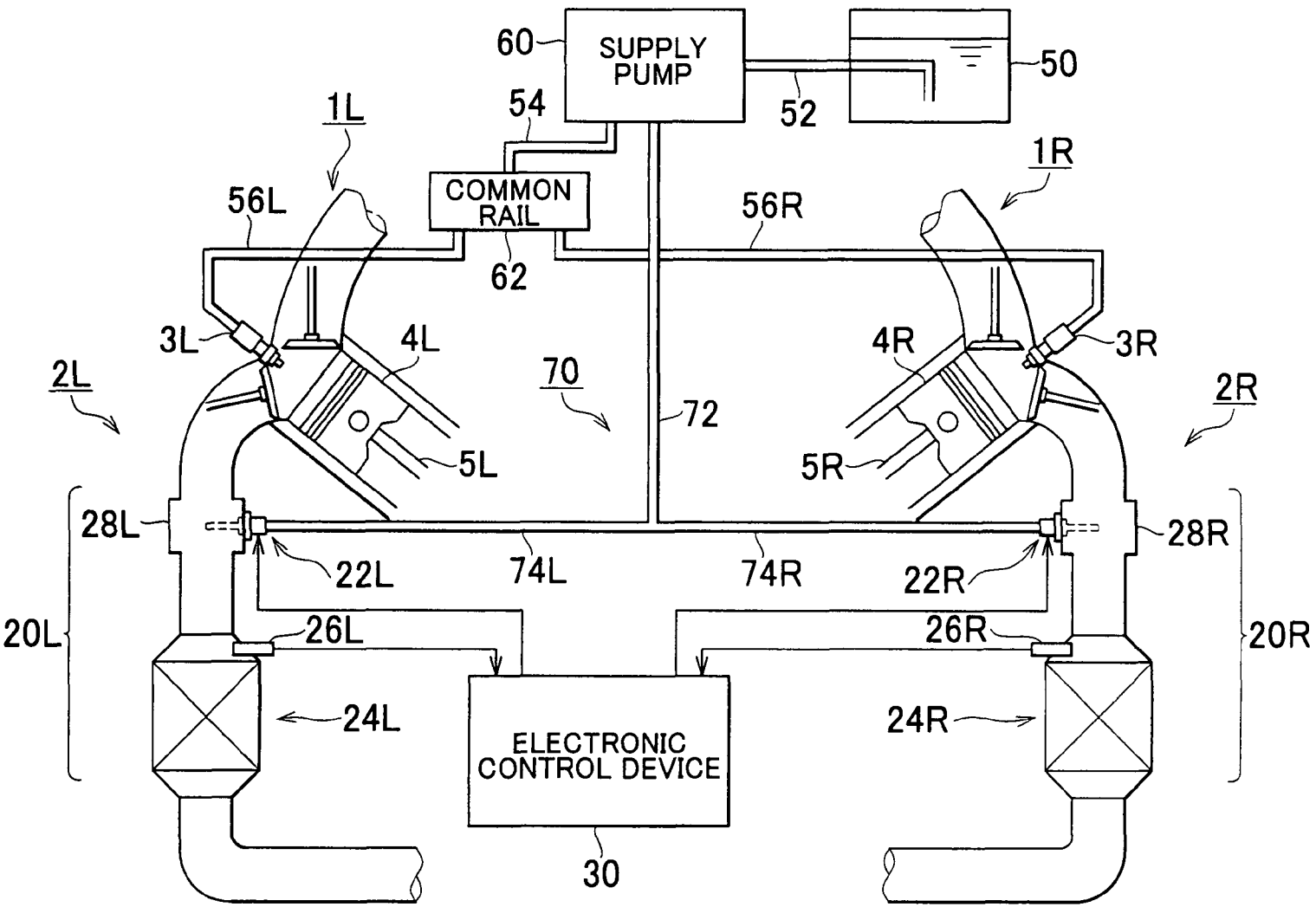
FIG. 1 is a block diagram showing exhaust purification devices and a control device thereof in accordance with the first embodiment of the invention.

As shown in FIG. 1, the right and left banks of a V-type 6-cylinder engine are each provided with three cylinders. To simplify the description herein, only the foremost cylinders, among the cylinders of the right and left banks, are shown in FIG. 1.

The engine has intake passageways 1R, 1L for supplying intake air into the cylinders, and exhaust passageways 2R, 2L for discharging exhaust gas produced by combustion in each cylinder. Intake manifolds are disposed respectively on the right and left banks as portions for connection of the intake passageways 1R, 1L to the cylinders. Intake air supplied through the intake passageways 1R, 1L is introduced into the cylinders through the intake manifolds.

Each cylinder is provided with a fuel injection valve 3R, 3L. As fuel injected from the fuel injection valves 3R, 3L burns and explodes, pistons 4R, 4L in the cylinders move up and down in the directions of their axes. Due to the upward and downward movements of the pistons 4R, 4L, a crankshaft (not shown) is rotationally driven via connecting rods 5R, 5L connected to the pistons 4R, 4L.

Fuel is stored in a fuel tank 50. Through fuel passageways 52, 54, fuel is pressure-fed to a common rail 62 by a supply pump 60. The common rail 62 stores, at high pressure, the fuel pressure-fed from the supply pump 60. Fuel injection valves 3R, 3L are supplied with high-pressure fuel from the common rail 62.

Exhaust manifolds are disposed respectively on the right and left banks as portions for connection of exhaust passageways 2R, 2L to the cylinders. Exhaust gas produced by combustion in each cylinder is discharged into the exhaust passageways 2R, 2L through the exhaust manifolds.

Exhaust purification devices 20R, 20L are disposed in the exhaust passageways 2R, 2L, respectively. Each exhaust purification device 20R, 20L has an addition valve 22R, 22L, a catalyst portion 24R, 24L, and an air-fuel ratio sensor 26R, 26L.

In the catalyst portion 24R, 24L, a DPNR (Diesel Particulate-NOx Reduction system) catalyst for lessening the amount of PM (particulate matter) and the amount of NOx in exhaust gas is disposed.

The DPNR catalyst is formed by supporting a NOx storage-reduction type catalyst on a porous ceramic structure. When exhaust gas passes through walls of the porous structure, PM in exhaust gas is trapped. Air-fuel ratio sensors 26R, 26L are disposed at an upstream side of the catalyst portions 24R, 24L, that is, a side thereof that is upstream with respect to the flow of exhaust gas. The air-fuel ratio sensors 26R, 26L detect the air-fuel ratios on the basis of the oxygen concentrations in the exhaust gas introduced into the catalyst portions 24R, 24L, respectively. The detected values are output to an electronic control device 30.

Each exhaust passageway 2R, 2L has a cylindrical addition chamber 28R, 28L that is larger in diameter than the other portion. Addition valves 22R, 22L for addition fuel into the exhaust passageways 2R, 2L are disposed in the addition chambers 28R, 28L, respectively.

These addition valves 22R, 22L are supplied with fuel, as an additive, from the fuel tank 50. Specifically, fuel in the fuel tank 50 is pressure-fed to the addition valves 22R, 22L through a supply passageway 70 by the supply pump 60.

The supply passageway 70 has branch portions 74R, 74L connected to the addition valves 22R, 22L, respectively, and a common portion 72 to which the branch portions 74R, 74L are joined and which is connected to the supply pump 60.

The electronic control device 30 computes periods of addition and amounts to be added by the addition valves 22R, 22L, on the basis of the operation state of the engine, such as the air-fuel ratios detected by the air-fuel ratio sensors 26R, 26L, the cooling water temperature, etc. On the basis of these computed values, the electronic control device 30 controls the opening/closing actuation of the addition valves 22R, 22L.

In the case of a diesel engine, the air-fuel ratio is normally on the lean side. Therefore, before the amount of NOx stored in the DPNR catalyst saturates the catalyst, the air-fuel ratio needs to be changed to the rich side so as to reduce and release NOx stored in the catalysts Furthermore, in the DPNR catalyst, if the amount of deposition of PM trapped thereby becomes large, the pressure loss in the catalyst increases. Therefore, before the pressure loss increases to where it affects the operation state of the engine and the like, it is necessary to decrease the deposition of PM by combustion, that is, perform a so-called recovery process of the DPNR catalyst.

Still further, the DPNR catalyst has a property of absorbing SOx (oxides of sulfur) generated from a sulfur component contained in the fuel or lubricating oil, as well as the property of storing NOx. It is to be noted herein that there is a limit to the amount of storage in the DPNR catalyst. Hence, there occurs a phenomenon of deterioration of the NOx removing function due to so-called SOx poisoning, in which the storage capacity of NOx decreases as the amount of absorbed Sox increases. It is also known that SOx absorbed in the DPNR catalyst is released in a high temperature (near 600° C.) reducing atmosphere. Under such a condition, the amount of SOx absorbed in the DPNR catalyst is reduced.

Therefore, the electronic control device 30 executes a NOx reduction process, a DPNR catalyst restoration process, and a SOx poisoning recovery process by performing the supply of fuel via the addition valves 22R, 22L:

when the NOx storage amount estimated on the basis of the operation state of the engine and the like reaches a predetermined value, that is, a set value that precedes a limit value of the NOx storage amount;

when the PM deposition amount estimated on the basis of the operation state of the engine, the difference between the exhaust pressure on the upstream side and the exhaust pressure on the downstream side of the catalyst portion, etc. reaches a predetermined value, that is, a set value that precedes a limit value at which the PM deposition amount adversely affects the operation state of the engine and the like; and when the SOx absorption amount estimated on the basis of the operation state of the engine and the like reaches a predetermined value, that is, a set value that precedes a limit value at which the SOx absorption amount adversely affects the storage of NOx. When the fuel supplied on this occasion reaches the DPNR catalyst, the fuel acts as a NOx reducing agent, a PM combustion-accelerating agent, and a SOx reducing agent. By these processes, the NOx removing function of the DPNR catalyst is maintained.

A procedure of controlling the addition valves 22R, 22L, specifically, a procedure of setting addition periods τR, τL of the addition valves 22R, 22L, will be described below with reference to the flowchart of FIG. 2. A series of processes shown in this flowchart is, in reality, executed by the electronic control device 30 periodically on a predetermined cycle.

Figure 2:
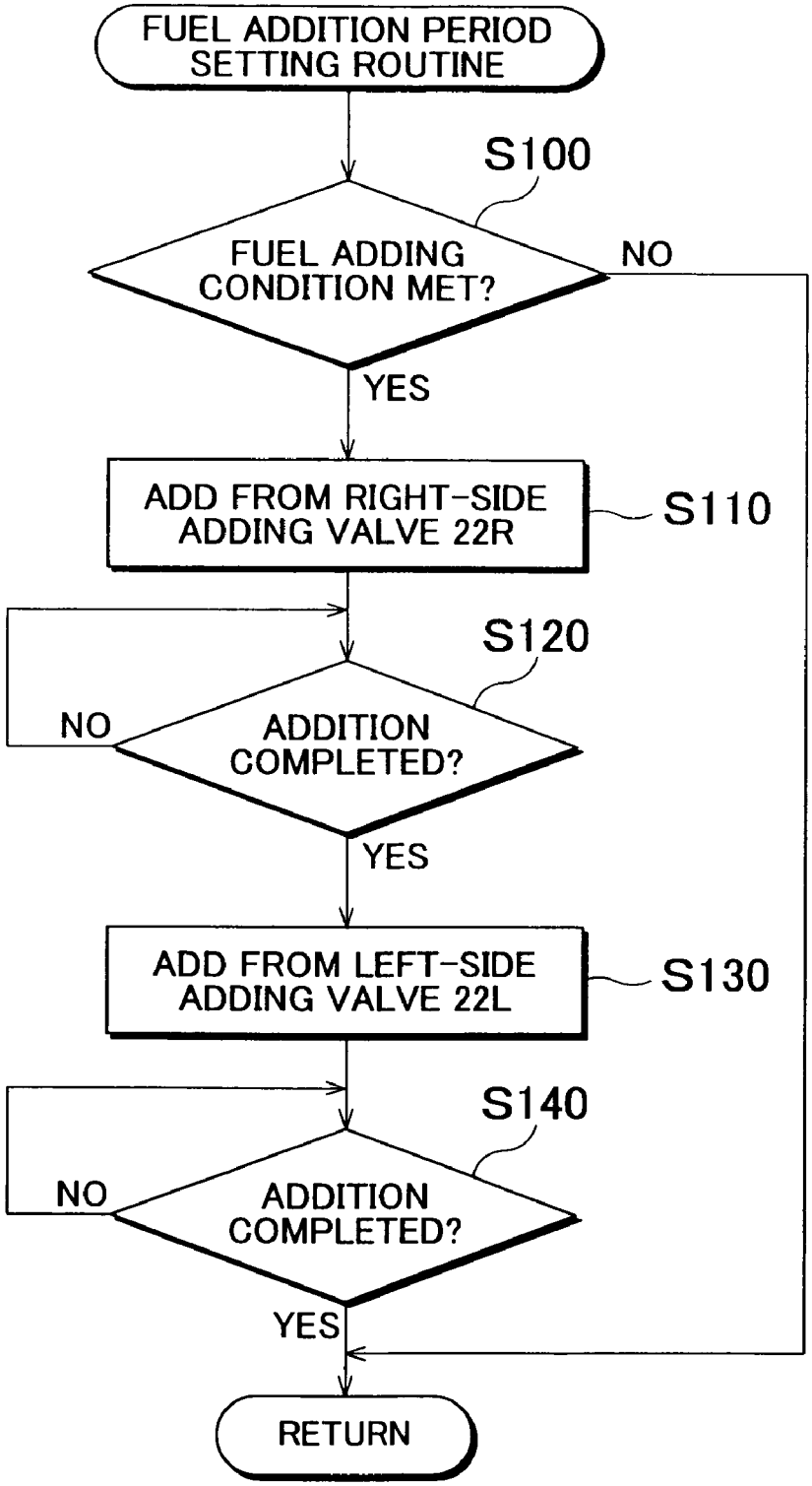
FIG. 2 is a flowchart showing a process procedure of a control of the exhaust purification devices.

As shown in FIG. 2, in this series of processes, it is first determined whether or not a condition for addition fuel to the catalyst portions 24R, 24L is met (step 100). In this embodiment, fuel is added on the condition that the at least one of the NOx storage amount, the PM deposition amount and the SOx absorption amount described above in conjunction, respectively, with the NOx reduction process, the DPNR catalyst restoration process and the SOx poisoning recovery process have reached a predetermined value set in relation to its limit value If it is determined, through this determination process, that the condition for fuel addition is not met (NO at step 100), it is assumed that there is no need to add fuel at the present time, and the routine is temporarily ended.

On the other hand, if it is determined, through the determination process, that the condition for fuel addition is met (YES at step 100), fuel is added from the right-side addition valve 22R of the right and left addition valves 22R, 22L (step 110). The period τR of addition of fuel from the right-side addition valve 22R is computed by the electronic control device 30 on the basis of the operation state of the engine, and the like.

After the addition of fuel from the right-side addition valve 22R is begun in this manner (step 110), it is determined whether or not the addition of fuel from the right-side addition valve 22R has been completed (step 120). If it is determined that the addition of fuel from the right-side addition valve 22R has not been completed (NO at step 120), progress to the next step is suspended until the addition of fuel is completed.

On the other hand, if it is determined, through the determination process, that the addition of fuel from the right-side addition valve 22R has been completed (YES at step 120), fuel is then added from the addition valve 22L provided on the left-side exhaust passageway 2L (step 130). Similar to the above-described addition period τR of the right-side addition valve 22R, the period τL of addition of fuel from the left-side addition valve 22L is computed by the electronic control device 30 on the basis of the operation state of the engine and the like. In this embodiment, the addition period τL of the left-side addition valve 22L and the addition period τR of the right-side addition valve 22R are set as equal lengths of time for the sake of a simple construction. However, the addition periods τR, τL of the right and left addition valves 22R, 22L may be set independently of each other on the basis of the air-fuel ratios λR, λL and the temperatures TcR, TcL of the catalyst portions 24R, 24L, etc.

After the addition of fuel from the left-side addition valve 22L is begun in this manner (step 130), it is determined whether or not the addition of fuel from the left-side addition valve 22L has been completed (step 140). If it is determined that the addition of fuel from the left-side addition valve 22L has not been completed (NO at step 140), progress to the next step is suspended until the addition of fuel is completed.

On the other hand, if it is determined, through this determination process, that the addition of fuel from the left-side addition valve 22L has been completed (YES at step 140), the routine is temporarily ended. Now, control modes of the control device of the exhaust purification devices in accordance with this embodiment will be described in detail with reference to FIGS. 3A to 5E.

In the following description, various factors that contribute to the drop of the fuel pressure P in the common portion 72 that accompanies the addition of fuel from the right-side addition valve 22R of the two addition valves 22R, 22L will be described.

Figure 3A:
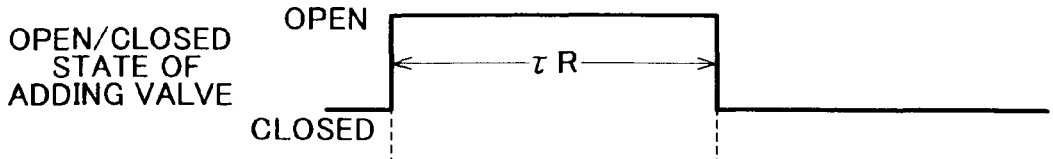
FIGS. 3A to 3D are time charts showing a relationship between the open/closed state of an addition valve and the fuel pressure in a common portion of a supply passageway.
Figure 3B:
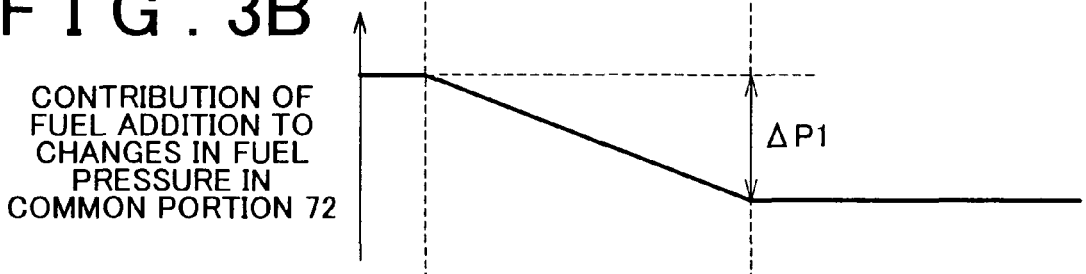
Figure 3C:
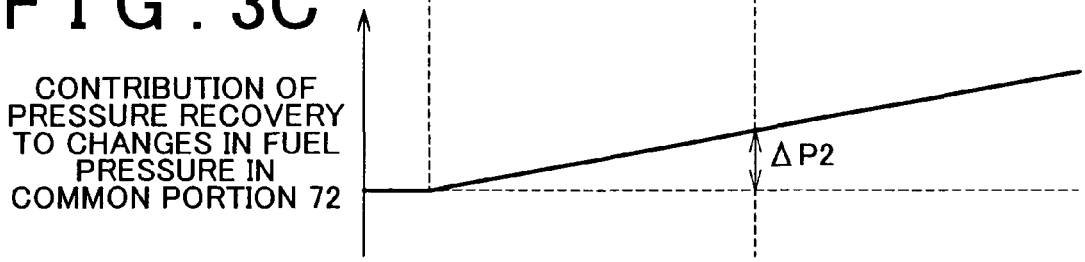
Figure 3D:
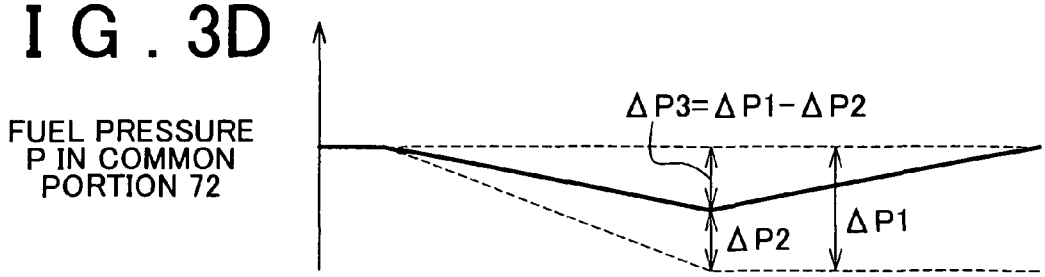

FIGS. 3A to 3D show a relationship between the addition period τR of the addition valve 22R and the fuel pressure P in the common portion 72. As shown in FIGS. 3A to 3D, when the addition valve 22R is opened to add fuel for the addition period τR (FIG. 3A), the fuel in the branch portion 74R is supplied from the addition valve 22R into the addition chamber 28R, so that the fuel pressure in the branch portion 74R drops. Therefore, the fuel pressure P in the common portion 72 located upstream of the branch portion 74R drops by ΔP1 at the elapse of the addition period τR (FIG. 3B). In reality, however, since fuel is pressure-fed from the upstream side of the supply passageway 70 by the supply pump 60, the fuel pressure P in the common portion 72 recovers by ΔP2 at the elapse of the addition period τR. As a result, the fuel pressure P in the common portion 72 of the supply passageway 70 drops by the amount ΔP3 (=ΔP1−ΔP2) obtained by subtracting ΔP2 from ΔP1.

Next, with reference to FIGS. 4A to 4E, changes in the fuel pressure P in the common portion 72 in the case of a related-art technology where if the condition for fuel addition is met, fuel is added simultaneously from the two addition valves 22R, 22L will be described.

As shown in FIGS. 4A to 4E, when the condition for the addition of fuel to the catalyst portions 24R, 24L is met (FIG. 4A), the right-side addition valve 22R and the left-side addition valve 22L are simultaneously opened to add fuel for the addition period τR, τL (FIGS. 4B and 4C). As a result, the fuel pressure in the branch portion 74R and the fuel pressure in the branch portion 74L simultaneously drop, so that the fuel pressure P in the common portion 72 drops from P1 to P4 by the amount ΔP4 (=ΔP1×2−ΔP2) (FIG. 4E). This amount of drop is explained as follows. That is, the simultaneous addition of fuel from the two addition valves 22R, 22L doubles the contribution of the fuel pressure drop caused by the fuel addition to the changes in the fuel pressure in the common portion 72, while the amount of fuel pressure recovery ΔP2 is equal to the amount of recovery obtained in the case where fuel is added from one addition valve 22R (FIG. 4E).

Thus, in the case where the addition periods τR, τL of the two addition valves 22R, 22L are set as the same period, the fuel pressure P in the common portion 72, during the addition period τR, τL of the addition valves 22R, 22L, becomes lower than a fuel pressure Pth at which deterioration of the atomization of fuel supplied into the exhaust passageways 2R, 2L begins.

FIGS. 5A to 5E show a relationship between the addition periods τR, τL of the addition valves 22R, 22L and the fuel pressure P in the common portion 72. As shown in FIGS. 5A to 5E, when the condition for the fuel addition from the right-side addition valve 22R is met (FIG. 5A), the right-side addition valve 22R is opened to add fuel for the addition period τR (FIG. 5B). As a result, the fuel pressure in the right-side branch portion 74R drops, so that the fuel pressure P in the common portion 72 drops from P1 by ΔP1 to P2 (FIG. 5E).

Subsequently, when the fuel addition from the right-side addition valve 22R is completed, the condition for the fuel addition from the left-side addition valve 22L is thereby met (FIG. 5C). Therefore, the addition valve 22L is opened to add fuel for the addition period TL (FIG. 5D). As a result, the fuel pressure P in the common portion 72 of the supply passageway 70 further drops from P2 by ΔP1 to P3. Thus, by alternating the addition periods τR, τL of the two addition valves 22R, 22L in the above-described manner, the drop of the fuel pressure per unit time is minimized. Therefore, during the addition period of each one of the addition valves 22R, 22L, the fuel pressure P in the common portion 72 is maintained at or above the fuel pressure Pth at which deterioration of the atomization of fuel supplied into the exhaust passageways 2R, 2L begins.

According to the above-described embodiment, the following operations and effects are obtained.

(1) The embodiment adopts a construction in which the two addition valves 22R, 22L are provided separately in the two exhaust passageways 2R, 2L, and in which the addition periods of the two addition valves 22R, 22L alternate so that the addition period τR of one addition valve 22R and the addition period τL of the other addition valve 22L do not overlap each other. This construction curbs the drop in the fuel supply pressure caused by the supply of fuel, by alternating the supplies of fuel from the two addition valves 22R, 22L, instead of simultaneously supplying fuel therefrom. As a result, a higher fuel supply pressure can be kept maintained than in the construction where fuel is supplied simultaneously from the two addition valves 22R, 22L. Therefore, the embodiment is able to curb the deterioration of the degree of atomization of fuel and therefore curb the decline of the exhaust purification rate.

(2) In the case where a supply passageway 70 for supplying fuel is provided between the pump 60 for pressure-feeding fuel and the two addition valves 22R, 22L, the supply passageway 70 has branch portions 74R, 74L connected to the addition valves 22R, 22L, respectively, and a common portion 72 to which the branch portions 74R, 74L are joined and which is connected to the pump 60. In this case, if fuel is supplied simultaneously from the two addition valves 22R, 22L, the pressure of fuel in the supply passageway 70 greatly drops, so that the fuel supply pressure drops.

Therefore, in the embodiment, a setting is made such that, as for the valves constituting the two addition valves 22R; 22L, the addition period τR of at least one addition valve 22R does not overlap with the addition period τL of the other addition valve 22L. Hence, the embodiment is able to curb the deterioration of the degree of atomization of fuel and therefore curb the decline of the exhaust purification rate.

(3) In this embodiment, when the supply of fuel from the addition valves 22R, 22L begins, the fuel pressure in the common portion 72 of the supply passageway 70, which connects the addition valves 22R, 22L and the pump 60, is greater than or equal to a predetermined magnitude Pth. Hence, the embodiment is able to curb the deterioration of the degree of atomization of fuel and therefore improve the exhaust purification rate. A second embodiment of the invention will be described in detail with reference to FIGS. 6 to 7E. This embodiment differs from the first embodiment in that after the addition of fuel from the right-side addition valve 22R is completed, the addition of fuel from the left-side addition valve 22L begins on the condition that the fuel pressure P in the common portion 72 has recovered to Pr. Incidentally, the exhaust purification devices 20R, 20L and the electronic control device 30 thereof in this embodiment have basically the same constructions as those in the first embodiment. The second embodiment further includes a pressure sensor (not shown) that detects the fuel pressure in the common portion 72 of the supply passageway 70. The following description will be made mainly with regard to differences from the first embodiment.

Figure 6:
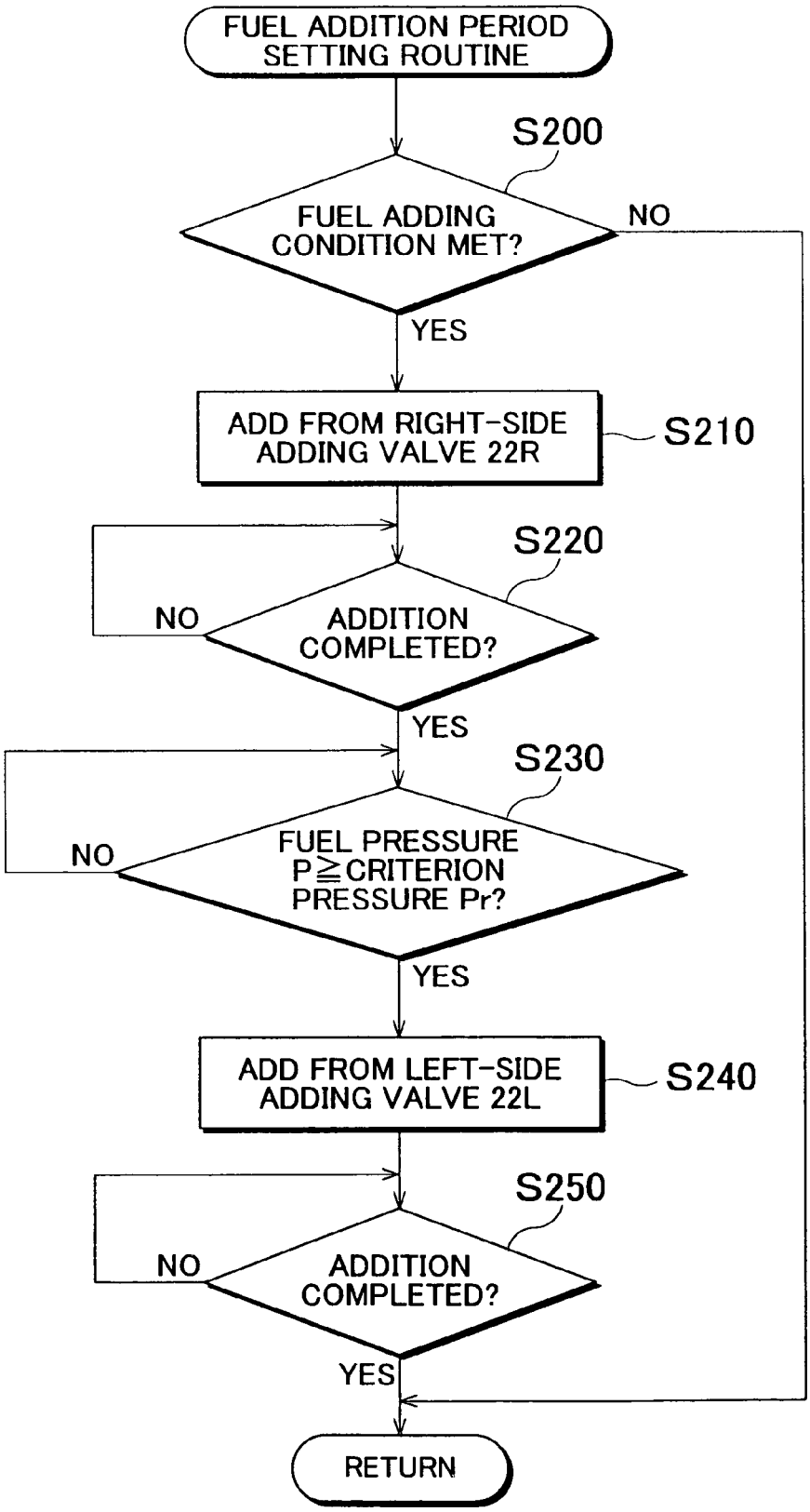
FIG. 6 is a flowchart showing a process procedure of a control of exhaust purification devices in accordance with the second embodiment of the invention.

A procedure of controlling the addition valves 22R, 22L, specifically, a procedure of setting addition periods τR, τL of the addition valves 22R, 22L, will be described below with reference to the flowchart of FIG. 6. The processes of steps 200 to 220 in this flowchart are the same as the processes of steps 100 to 120 in FIG. 2 described above in conjunction with the first embodiment, and will not be described below.

If it is determined that the addition of fuel from the right-side addition valve 22R has been completed (YES at step 220), it is then determined whether or not the fuel pressure P in the common portion 72 is greater than or equal to a threshold pressure Pr (step 230). The fuel pressure P in the common portion 72 is detected by a pressure sensor, and is output to the electronic control device 30. If the fuel pressure P in the common portion 72 is below the threshold pressure Pr (NO at step 230), progress to the next step is suspended until the fuel pressure P recovers to the pressure Pr.

On the other hand, if is determined that the fuel pressure P in the common portion 72 is greater than or equal to the threshold pressure Pr (YES at step 230), the addition of fuel from the addition valve 22L provided on the left-side exhaust passageway 2L is performed (step 240). The subsequent processes of steps 240, 250 are the same as the processes of steps 130, 140 in FIG. 2, and will not be described again.

Next, control modes of the control device of the exhaust purification devices in accordance with this embodiment will be described in detail with reference to FIGS. 7A to 7E. FIGS. 7A to 7E show a relationship between the addition period τR, τL of the addition valves 22R, 22L and the fuel pressure P in the common portion 72.

As shown in FIGS. 7A to 7E, when the condition for the addition of fuel from the right-side addition valve 22R is met (FIG. 7A), the addition valve 22R is opened to add fuel for the addition period τR (FIG. 7B). As a result, the fuel pressure in the right-side branch portion 74R drops, so that the fuel pressure P in the common portion 72 drops from P1 by ΔP1 to P2 (FIG. 7E).

Subsequently, after the addition of fuel from the right-side addition valve 22R is completed, the condition for the addition of fuel to the left-side catalyst portion 24L is not met until the fuel pressure P in the common portion 72 becomes equal to or greater than the threshold pressure Pr. Then, as the fuel pressure P becomes equal to the threshold pressure Pr, the condition for the fuel addition is met (FIG. 7C) and the addition valve 22L is opened to add fuel for the addition period τL (FIG. 7D). As a result, the fuel pressure P in the common portion 72 of the supply passageway 70 drops from the threshold pressure Pr by ΔP1 to P5 (FIG. 7E). Thus, the fuel pressure P in the common portion 72 is controlled so that during the addition periods of the addition valves 22R, 22L, the fuel pressure P is greater than a fuel pressure Pth at which deterioration of the atomization of fuel supplied into the exhaust passageways 2R, 2L begins.

According to the above-described embodiment, the following operations and effects are obtained.

(1) According to the embodiment, substantially the same effects as in the first embodiment and the following effects are obtained. That is, by the time when the supply of fuel from the addition valve 22L is begun, the fuel pressure P in the common portion 72 of the supply passageway 70 which connects the addition valves 22R, 22L and the pump 60 has become equal to or greater than the criterion pressure Pr (>Pth). Hence, the embodiment is able to further curb the deterioration of the degree of atomization of fuel and therefore improve the exhaust purification rate.

The foregoing embodiments may be carried out with the following modifications.

The foregoing embodiments have been described in conjunction with the exhaust purification devices of a V-type 6-cylinder diesel engine. However, the invention can also be applied to exhaust purification devices of engines the number of whose cylinders is other than six. The invention can also be applied to horizontally-opposed engines and even to in-line type engines provided that the engine is equipped with addition valves that supply fuel pressure-fed by the same pump, to two exhaust purification devices separately from each other.

In the foregoing embodiments, after the fuel addition from the right-side addition valve 22R is completed, the fuel addition from the left-side addition valve 22L is begun. However, the fuel addition from the left-side addition valve 22L may begin before the fuel addition from the right-side addition valve 22R is completed. As shown in FIGS. 8A to 8E, at the elapse of a predetermined period Δt1 following the beginning of the fuel addition from the right-side addition valve 22R, the fuel pressure P in the common portion 72 has dropped from P1 by ΔP1a to Pa. Then, during the period from this time point until the fuel addition from the right-side addition valve 22R is completed, fuel is added from both the right-side addition valve 22R and the left-side addition valve 22L. At the time of completion of the fuel addition from the right-side addition valve 22R, the fuel pressure P has dropped from the pressure Pa occurring at the beginning of the fuel addition from the left-side addition valve 22L, by ΔP1b to Pb. From this time on, the fuel addition from only the left-side addition valve 22L is continued. Therefore, the fuel pressure P at the time of completion of the fuel addition from the left-side addition valve 22L has further dropped by ΔP1a to P6. As a result, immediately prior to the end of the addition period of the addition valve 22L, the fuel pressure P in the common portion 72 becomes lower than the fuel pressure Pth at which deterioration of the atomization of fuel supplied into the exhaust passageways 2R, 2L begins; however, the period during which the fuel pressure P is lower than Pth is decreased in comparison to the related art.

Figure 9A:
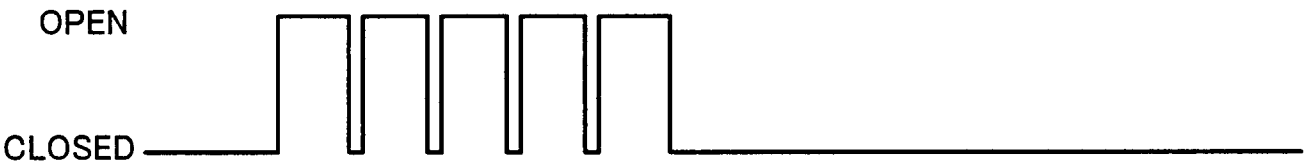
FIGS. 9A and 9B are time charts showing a modification of an opening/closing control of the addition valves in accordance with the invention.
Figure 9B:
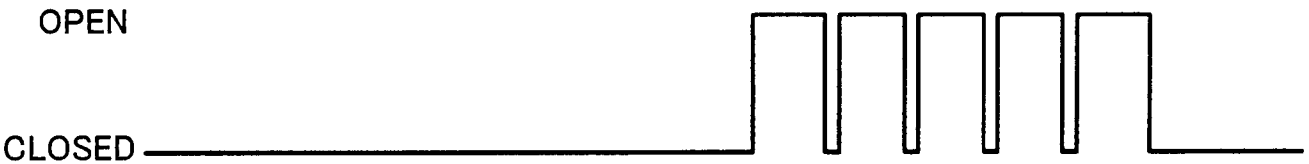
Figures 10A, 10B:
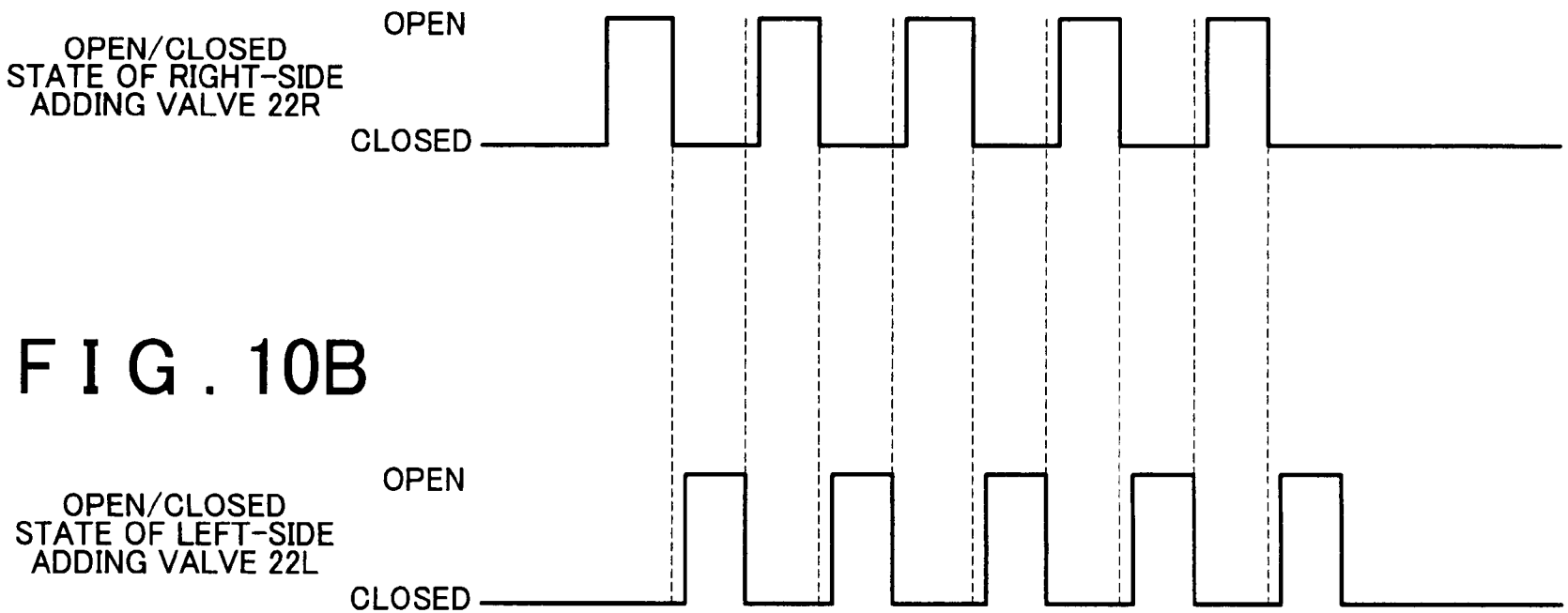
FIGS. 10A and 10B are time charts showing another modification of the opening/closing control of the addition valves in accordance with the invention.

Although the foregoing embodiments adopt a model in which each one of the addition valves 22R, 22L performs fuel addition by one operation for the convenience of description, the fuel addition from each addition valve 22R, 22L may be performed in a divided fashion as shown in FIGS. 9A and 9B. Furthermore, as shown in FIGS. 10A and 10B, the fuel addition from each addition valve 22R, 22L is divided, and is performed so that the fuel addition from the right-side addition valve 22R and the fuel addition from the left-side addition valve 22L alternate. In these cases, the fuel pressure P in the common portion 72 rises during periods when both addition valves 22R, 22L are closed, so that it is possible to further curb the drop of the supply pressure of the fuel to be added into the addition chambers 28R, 28L, besides achieving the effects of the foregoing embodiments.

Although in the foregoing embodiments, the fuel addition from the right-side addition valve 22R is first performed, it is also permissible to begin the fuel addition with the addition from the left-side addition valve 22L.

The foregoing embodiments have been described in conjunction with two addition valves 22R, 22L. However, the embodiments of the invention can also be applied to constructions in which three or more addition valves are provided in three or more exhaust passageways. In this case, too, it is appropriate that, as for addition valves constituting the plurality of addition valves, the addition period of at least one addition valve be set so as to be different from the addition period of another addition valve.

In the foregoing embodiments, diesel engine fuel is adopted as an additive. However, the additive may be changed to other substances, such as urea and the like, in accordance with the construction of the exhaust purification devices.

What is claimed is:

1. A control device of an exhaust purification device for an engine, comprising:

a plurality of addition valves that supply an additive to a plurality of separate exhaust purification catalysts;

a supply passageway that is provided between a pump and the plurality of addition valves, and that supplies the additive to each of the plurality of addition valves from the pump, the supply passageway including branch portions that are connected to the plurality of addition valves, and a common portion to which the branch portions are joined and that is connected to the pump;

at least one controller that controls operation of the plurality of addition valves based on a supply pressure in the common portion of the supply passageway, and that controls operation of the plurality of addition valves such that an addition period of a first addition valve of the plurality of addition valves is set to begin at a different time than an addition period of a second addition valve of the plurality of addition valves, wherein the plurality of addition valves are located downstream of a plurality of exhaust valves provided to respective cylinders of the engine.

2. The control device of the exhaust purification device according to claim 1, further comprising a pressure sensor that detects the supply pressure in the common portion of the supply passageway, wherein the at least one controller initiates supply of the additive via the plurality of addition valves when the supply pressure of the additive in the common portion of the supply passageway is greater than or equal to a predetermined magnitude.

3. The control device of the exhaust purification device according to claim 1, wherein the engine is a V-type engine.

4. The control device of the exhaust purification device according to claim 1, wherein the at least one controller controls the first and second addition valves such that the first addition valve and the second addition valve are actuated sequentially with a pre-determined non-actuation period interjected between the addition period of the first addition valve and the addition period of the second addition valve.

5. The control device of the exhaust purification device according to claim 1, wherein the first and second addition valves are separately provided from fuel injection valves provided to the respective engine cylinders.

6. The control device of the exhaust purification device according to claim 1, wherein the first and second addition valves are respectively provided in two separate exhaust passage systems, and wherein the addition period of the first addition valve is set so as not to overlap with the addition period of the second addition valve.

7. The control device of the exhaust purification device according to claim 6, wherein the first addition valve is provided in a wall of a first of the two separate exhaust passage systems, and wherein the second addition valve is provided in a wall of a second of the two separate exhaust passage systems.

8. The control device of the exhaust purification device according to claim 6, wherein the two separate exhaust passage systems begin at exhaust manifolds of the engine.

9. The control device of the exhaust purification device according to claim 1, wherein the at least one controller controls the operation of the first and second addition valves such that the additive supplied during the addition period of each of the first and second addition valves is sub-divided into pulses so as to supply the additive non-continuously over the addition period.

10. The control device of the exhaust purification device according to claim 9, wherein the at least one controller controls the operation of the first and second addition valves such that the non-continuous pulses of the first addition valve alternate with the non-continuous pulses of the second addition valve.

11. A control method for an exhaust purification device for an engine including a plurality of addition valves that supply an additive that is pressure-fed from a pump to a plurality of separate exhaust purification catalysts, comprising:

controlling operation of the plurality of addition valves based on a supply pressure in a supply passageway provided between the pump and the plurality of addition valves, setting an addition period of a first addition valve of the plurality of addition valves so as to be different from an addition period of a second addition valve of the plurality of addition valves, and wherein the plurality of addition valves are located downstream of a plurality of exhaust valves provided to respective cylinders of the engine.

12. The control method according to claim 11, wherein the supply passageway comprises branch portions connected to the plurality of addition valves, and a common portion to which the branch portions are joined and which is connected to the pump, the method further comprising, initiating the supply of the additive via the addition valves when the supply pressure of the additive in the common portion of the supply passageway is greater than or equal to a predetermined magnitude.

13. The control method according to claim 11 further comprising:

actuating the first addition valve and the second addition valve sequentially with a pre-determined non-actuation period interjected between the addition period of the first addition valve and the addition period of the second addition valve.

14. The control method according to claim 11, wherein the first and second addition valves are separately provided from fuel injection valves provided to the respective engine cylinders.

15. The control method according to claim 11, wherein the first and second addition valves are respectively provided in two separate exhaust passage systems, and wherein the setting the addition period includes setting the addition period of the first addition valve so as not to overlap with the addition period of the second addition valve.

16. The control method according to claim 15, wherein the first addition valve is provided in a wall of a first of the two separate exhaust passage systems, and wherein the second addition valve is provided in a wall of a second of the two separate exhaust passage systems.

17. The control device of the exhaust purification device according to claim 15, wherein the two separate exhaust passage systems begin at exhaust manifolds of the engine.

18. The control method according to claim 11, further comprising:

supplying the additive during each of the first and second addition periods such that the additive is sub-divided into pulses so as to supply the additive non-continuously over the respective addition period.

19. The control method according to claim 18, further comprising:

alternating the non-continuous pulses of the first addition valve with the non-continuous pulses of the second addition valve.

20. A control device of an exhaust purification device for an engine, comprising:

a plurality of addition valves that supply an additive to a plurality of separate exhaust purification catalysts;

a supply passageway that is provided between a pump and the plurality of addition valves, and that supplies the additive to each of the plurality of addition valves from the pump, the supply passageway including branch portions that are connected to the plurality of addition valves, and a common portion to which the branch portions are joined and that is connected to the pump; and at least one controller that controls operation of the plurality of addition valves based on a supply pressure in the common portion of the supply passageway, and that controls operation of the plurality of addition valves such that an addition period of a first addition valve of the plurality of addition valves is set to begin at a different time than an addition period of a second addition valve of the plurality of addition valves, and wherein a portion of the addition period of the first addition valve overlaps with a portion of the addition period of the second addition valve.

21. The control device of the exhaust purification device according to claim 20, wherein the at least one controller controls the operation of the first and second addition valves such that the additive supplied during the addition period of each of the first and second addition valves is sub-divided into pulses so as to supply the additive non-continuously over the addition period.

22. The control device of the exhaust purification device according to claim 21, wherein the at least one controller controls the operation of the first and second addition valves such that the non-continuous pulses of the first addition valve alternate with the non-continuous pulses of the second addition valve.

23. A control method for an exhaust purification device for an engine including a plurality of addition valves that supply an additive that is pressure-fed from a pump to a plurality of separate exhaust purification catalysts, comprising:

controlling operation of the plurality of addition valves based on a supply pressure in a supply passageway provided between the pump and the plurality of addition valves, setting an addition period of a first addition valve of the plurality of addition valves so as to be different from an addition period of a second addition valve of the plurality of addition valves, setting the addition period of the first addition valve to begin at a different time than the addition period of the second addition valve, and wherein a portion of the addition period of the first addition valve overlaps with a portion of the addition period of the second addition valve.

24. The control method according to claim 23, further comprising:

supplying the additive during each of the first and second addition periods such that the additive is sub-divided into pulses so as to supply the additive non-continuously over the respective addition period.

25. The control method according to claim 24, wherein the supplying includes alternating the non-continuous pulses of the first addition valve with the non-continuous pulses of the second addition valve.

* * * * *